US006688267B1

(12) United States Patent
Raghavan

(10) Patent No.: US 6,688,267 B1
(45) Date of Patent: Feb. 10, 2004

(54) ENGINE VALVE ACTUATOR ASSEMBLY

(75) Inventor: Madhusudan Raghavan, West Bloomfield, MI (US)

(73) Assignee: General Motors Corporation, Detroit, MI (US)

( * ) Notice: Subject to any disclaimer, the term of this patent is extended or adjusted under 35 U.S.C. 154(b) by 0 days.

(21) Appl. No.: 10/392,296

(22) Filed: Mar. 19, 2003

(51) Int. Cl.[7] ..... F01L 1/34
(52) U.S. Cl. ..... 123/90.16; 74/569; 123/90.15
(58) Field of Search ..... 123/90.15, 90.16, 123/90.17, 90.24, 90.25, 90.26, 90.39, 90.4, 90.41, 90.42, 90.43, 90.44, 90.45, 90.46, 90.47; 74/569

(56) References Cited

U.S. PATENT DOCUMENTS 1,703,858 A * 3/1929 Banner ..... 123/373
3,157,166 A * 11/1964 MacNeill ..... 123/90.16
4,459,946 A 7/1984 Burandt
5,373,818 A 12/1994 Unger
6,112,711 A 9/2000 Shimizu et al.

* cited by examiner

*Primary Examiner*—Thomas Denion
*Assistant Examiner*—Jaime Corrigan
(74) *Attorney, Agent, or Firm*—Kathryn A. Marra

(57) ABSTRACT

A valve actuator assembly for an engine includes a movable engine valve. The valve actuator assembly also includes a movable roller finger follower contacting the engine valve, a rotatable cam, and first and second intermediate finger followers for contact with the roller finger follower and the cam. The valve actuator assembly also includes at least one first actuator operatively cooperating with the first intermediate finger follower to position the first intermediate finger follower relative to the cam to move the roller finger follower to position the engine valve at either one of a desired lift and phasing for a primary opening of the engine valve and at least one second actuator operatively cooperating with the second intermediate finger follower to position the second intermediate finger follower relative to the cam to move the roller finger follower to position the engine valve at either one of a desired lift and phasing for a secondary opening of the engine valve.

20 Claims, 2 Drawing Sheets

ENGINE VALVE ACTUATOR ASSEMBLY

TECHNICAL FIELD

The present invention relates generally to intake or exhaust valve actuators for engines and, more particularly, to a valve actuator assembly for continuously variable secondary opening of an engine valve for an internal combustion engine.

BACKGROUND OF THE INVENTION

It is known to provide a valve train or valve actuator assembly for an engine such as an internal combustion engine of a vehicle such as a motor vehicle. Typically, the valve train includes one or more valves, a cam shaft having one or more cams, and a tappet contacting each cam and valve. Typically, engine valve actuation is accomplished via the engine-driven driven camshaft.

It is also known to provide a valve train for an internal combustion engine having a valve with an adjustable stroke or variable lift. In this patent, the adjustment of the stroke or lift of the valve takes place by an eccentric shaft, which displaces the supporting point of a transfer element disposed between each cam and each intake/exhaust valve, in which case the two eccentrics assigned to one cylinder are of a different geometry. The transfer element is formed by a valve lever, which is supported on the eccentric and is actuated by the cam, which valve lever, in turn, acts upon a rocker lever.

One disadvantage of some of these valve trains is that desired phasing is achieved via a camshaft phaser, which is unacceptable for high compression combustion systems, wherein each valve must be capable of having its own specifiable lift and phase setting. Another disadvantage of some of these valve trains is that they do not provide secondary opening of the engine valve. A further disadvantage of some of these valve trains is that the do not provide variable valve lift and phasing.

As a result, it is desirable to provide a valve actuator assembly for an engine that provides secondary opening of an engine valve. It is also desirable to provide a valve actuator assembly for an engine that has variable valve lift and phasing. It is further desirable to provide a valve actuator assembly for an engine having more than one degree-of-freedom to allow decoupling of lift and phasing for an engine valve. Therefore, there is a need in the art to provide a valve actuator assembly for an engine that meets these desires.

SUMMARY OF THE INVENTION

It is, therefore, one object of the present invention to provide a new valve actuator assembly for an engine.

It is another object of the present invention to provide a valve actuator assembly for an engine that has continuously variable secondary opening of an engine valve.

To achieve the foregoing objects, the present invention is a valve actuator assembly for an engine. The valve actuator assembly includes a movable engine valve. The valve actuator assembly also includes a movable roller finger follower contacting the engine valve, a rotatable cam, a first intermediate finger follower for contact with the roller finger follower and the cam, and a second intermediate finger follower for contact with the roller finger follower and the cam. The valve actuator assembly also includes at least one first actuator operatively cooperating with the first intermediate finger follower to position the first intermediate finger follower relative to the cam to move the roller finger follower to position the engine valve at either one of a desired lift and phasing for a primary opening of the engine valve. The valve actuator assembly includes at least one second actuator operatively cooperating with the second intermediate finger follower to position the second intermediate finger follower relative to the cam to move the roller finger follower to position the engine valve at either one of a desired lift and phasing for a secondary opening of the engine valve.

One advantage of the present invention is that a valve actuator assembly is provided for an engine for secondary opening of an engine valve. Another advantage of the present invention is that the valve actuator assembly has increased functionality, i.e., secondary opening of the engine valve with variable lift and phasing. Yet another advantage of the present invention is that the valve actuator assembly has precision and repeatability and does not suffer from temperature dependent fluid characteristics of hydraulic systems. A further advantage of the present invention is that the valve actuator assembly allows individual valve control for a high compression engine. Yet a further advantage of the present invention is that the valve actuator assembly has cam-based actuation that enables precise operation.

Other objects, features, and advantages of the present invention will be readily appreciated, as the same becomes better understood, after reading the subsequent description taken in conjunction with the accompanying drawings.

DESCRIPTION OF THE PREFERRED EMBODIMENT

Figures 1, 4, 5:
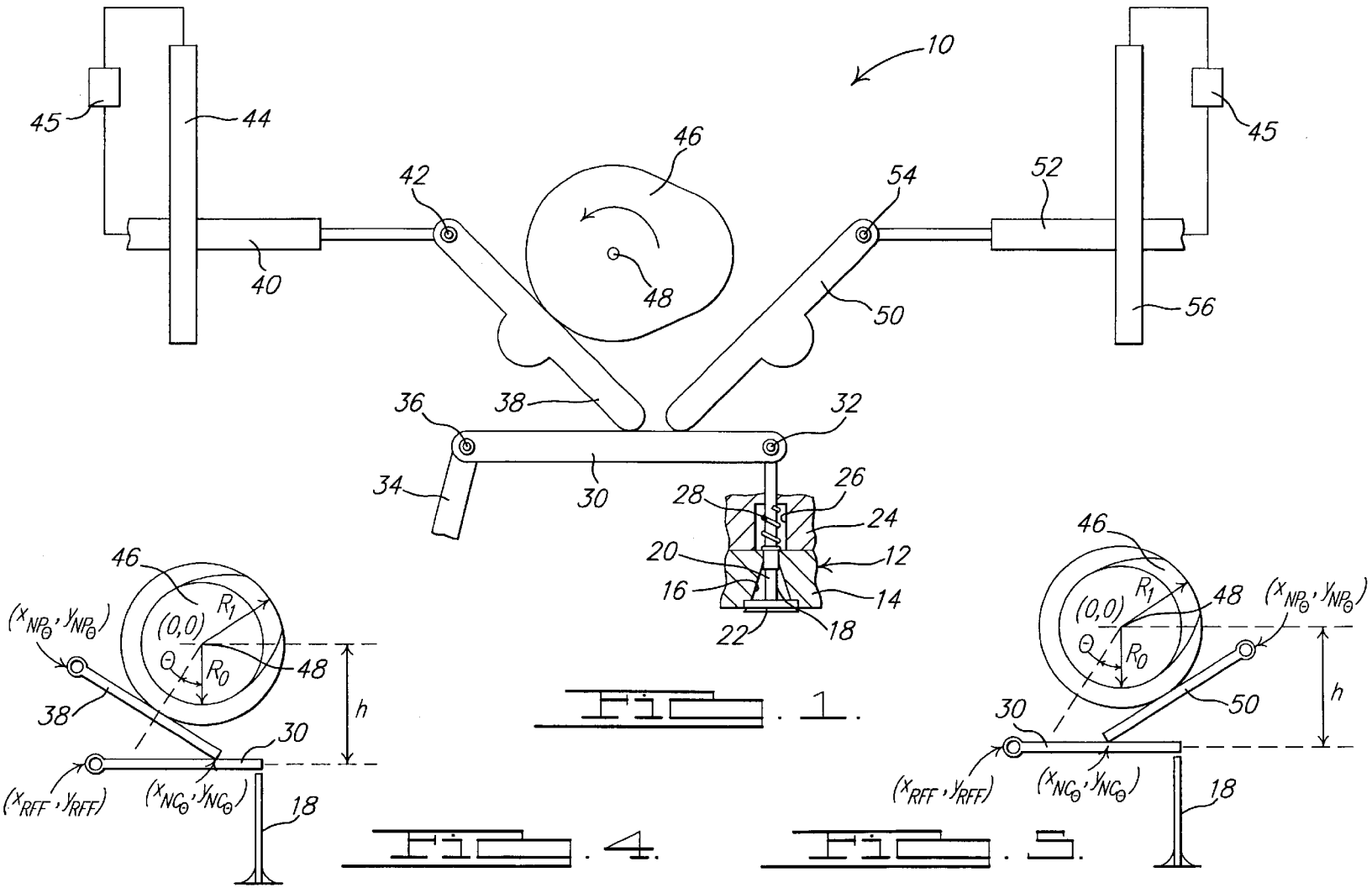
FIG. 1 is a diagrammatic view of a valve actuator assembly, according to the present invention, illustrated in operational relationship with an engine.
FIG. 4 is a diagrammatic view of the valve actuator assembly of FIG. 1 illustrated for computations of the location of a first intermediate finger follower.
FIG. 5 is a diagrammatic view of the valve actuator assembly of FIG. 1 illustrated for computations of the location of a second intermediate finger follower.

Referring to the drawings and in particular FIG. 1, one embodiment of a valve actuator assembly 10, according to the present invention, is shown for an engine, generally indicated at 12, of a vehicle (not shown). The engine 12 is of an internal combustion type. The engine 12 includes an engine block 14 having at least one opening 16 therein in communication with at least one internal combustion chamber (not shown). The engine 12 also includes a movable engine valve 18 for each opening 16. The engine valve 18 has a valve stem 20 and a valve head 22 at one end of the valve stem 20. The engine valve 18 is movable to open and close its respective opening 16 between an open position and a closed position. It should be appreciated that the engine valve 18 may be either an intake or exhaust valve. It should also be appreciated that the valve actuator assembly 10 is a valve train for the engine 12. It should further be appreciated that, except for the valve actuator assembly 10, the engine 12 is conventional and known in the art.

The valve actuator assembly 10 includes a housing 24 disposed adjacent the engine block 14. The housing 24 has a chamber 26 therein. The valve actuator assembly 10 includes an engine valve spring 28 disposed in the chamber 26 about the valve stem 20 and contacting the engine block 14 to bias the engine valve 18 toward the closed position. It should be appreciated that the valve head 22 closes the opening 16 when the engine valve 18 is in the closed position.

The valve actuator assembly 10 also includes a roller finger follower 30 to control the position of the engine valve 18. In the embodiment illustrated, the roller finger follower 30 has one end in contact with one end of the valve stem 20 opposite the valve head 22 at a contact point 32. The valve actuator assembly 10 may also include a hydraulic lash adjuster 34 adjacent the other end of the roller finger follower 30. The lash adjuster 34 is pivotally connected to the other end of the roller finger follower 30 at an attachment point 36. It should be appreciated that the attachment point 36 is a pivot point for the roller finger follower 30.

The valve actuator assembly 10 further includes a first intermediate finger follower 38 to control the position of the roller finger follower 30. In the embodiment illustrated, the first intermediate finger follower 38 has one end in contact with the roller finger follower 30. The valve actuator assembly 10 includes a first actuator 40 connected to one end of the first intermediate finger follower 38 at an attachment or pivot point 42 to position the first intermediate finger follower 38. The valve actuator assembly 10 also includes a second actuator 44 connected to the first actuator 40 to position the first actuator 40. The actuators 40 and 44 are of a linear type such as a solenoid electrically connected to a source of electrical power such as a controller 45. It should be appreciated that the second actuator 44 may be connected to one end of the first intermediate finger follower 38 at the pivot point 42 to position the first intermediate finger follower 38 and the first actuator 40 connected to the second actuator 44 to position the second actuator 44. It should also be appreciated that any suitable two degree-of-freedom device, such as a linear slide and rotary pivot or two rotary pivots in series, can be used to position the pivot point 42 in order to obtain a desired lift and phasing of the engine valve 18.

The valve actuator assembly 10 further includes at least one rotatable cam 46 attached to a cam shaft (not shown) for cooperating with the first intermediate finger follower 38. The cam 46 has a cam center 48 that is fixed but rotatable. It should be appreciated that the inclination of the first intermediate finger follower 38 provides phasing of the engine valve 18 and the distance of the first intermediate finger follower 38 from the cam center 48 provides lift of the engine valve 18. It should also be appreciated that the controller 45 energizes and de-energizes energizes the actuators 40 and 44 to move the intermediate finger follower 38.

The valve actuator assembly 10 further includes a second intermediate finger follower 50 to control the position of the roller finger follower 30 for a secondary opening of the engine valve 18. In the embodiment illustrated, the second intermediate finger follower 50 has one end in contact with the roller finger follower 30. The valve actuator assembly 10 includes a first actuator 52 connected to one end of the second intermediate finger follower 50 at an attachment or pivot point 54 to position the second intermediate finger follower 50. The valve actuator assembly 10 also includes a second actuator 56 connected to the first actuator 52 to position the first actuator 52. The actuators 52 and 56 are of a linear type such as a solenoid electrically connected to a source of electrical power such as the controller 45. It should be appreciated that the second actuator 56 may be connected to one end of the second intermediate finger follower 50 at the pivot point 54 to position the second intermediate finger follower 50 and the first actuator 52 connected to the second actuator 56 to position the second actuator 56. It should also be appreciated that any suitable two degree-of-freedom device, such as a linear slide and rotary pivot or two rotary pivots in series, can be used to position the pivot point 54 in order to obtain a desired lift and phasing of the engine valve 18. It should further be appreciated that the cam 46 is wide enough to push against both intermediate finger follower 38 and 50. It should still further be appreciated that the first intermediate finger follower 38 serves to execute the primary opening of the engine valve 18 and the second intermediate finger follower 50 serves to execute the secondary opening of the engine valve 18. It should also be appreciated that the intermediate finger followers 38 and 50 are in different planes to avoid mechanical interference with each other.

Figure 2:
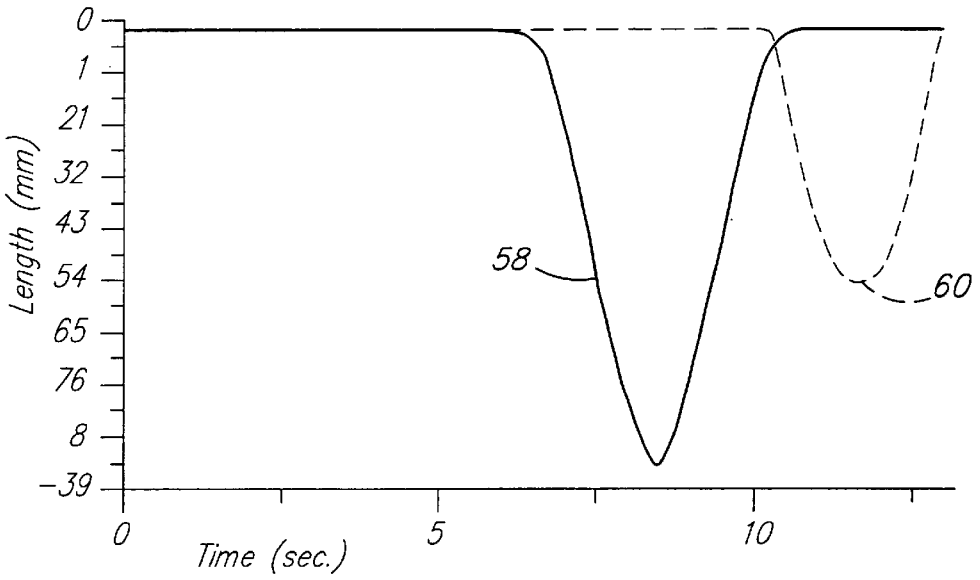
FIG. 2 is a curve of the valve actuator assembly of FIG. 1.

In operation of the valve actuator assembly 10, the engine valve 18 is shown in a closed position as illustrated in FIG. 1. When the cam 46, which is rotating in the counter-clockwise direction of FIG. 1, pushes down against the first intermediate finger follower 38, the first intermediate finger follower 38 rotates about its pivot point 42, pushing down against the roller finger follower 30, thereby opening the engine valve 18. As the cam 46 continues its rotation, the cam 46 ceases to make contact with the first intermediate finger follower 38 and the engine valve 18 closes. As the cam 46 further continues its rotation, the cam 46 contacts the second intermediate finger follower 50. As the cam 46 pushes against the second intermediate finger follower 50, the cam 46 causes the second intermediate finger follower 50 to rotate about its pivot point 54, pushing down against the roller finger follower 30, causing the engine valve 18 to open a second time. As the cam 46 continues its rotation, the cam 46 ceases to make contact with the second intermediate finger follower 50 and the engine valve 18 closes again. A sample valve lift curve having a primary valve opening 58 and a secondary valve opening 60 is shown in FIG. 2. It should be appreciated that the secondary valve opening 60 is required for re-breathing exhaust gases in advanced combustion schemes.

In the embodiment illustrated, the pivot of the first intermediate finger follower 38 is carried on by the actuators 40 and 44 in the horizontal (x) and vertical (y) directions. The actuators 40 and 44 enable the location of the pivot point 42 of the intermediate finger follower 38 at any point in the plane of FIG. 1. This allows independent control of lift and phasing of the engine valve 18. It should be appreciated that lift can be varied continuously from zero to a predetermined maximum lift. It should also be appreciated that phasing can also be varied continuously from minus fifteen degrees (−15°) of camshaft angle to plus fifteen degrees (+15°) of camshaft angle at any lift setting. It should further be appreciated that if only the lift of the primary valve opening is varied, a single actuator 40 is required to control the pivot position of the first intermediate finger follower 38. It should still further be appreciated that if lift and phasing are varied, such that they are coupled, only one actuator 40 is required. It should also be appreciated that, if lift and phasing are varied, independent of each other, both actuators 40 and 42 are required to control the position of the pivot of the first intermediate finger follower 38.

In the embodiment illustrated, the pivot of the second intermediate finger follower 50 is carried on by the actuators 52 and 56 in the horizontal (x) and vertical (y) directions. The actuators 52 and 56 enable the location of the pivot point 54 of the second intermediate finger follower 50 at any point in the plane of FIG. 1. This allows independent control of lift and phasing of the engine valve 18. It should be appreciated that lift can be varied continuously from zero to a predetermined maximum lift. It should also be appreciated that phasing can also be varied continuously for any camshaft angle, preferably from minus fifteen degrees (−15°) of camshaft angle to plus fifteen degrees (+15°) of camshaft angle, at any lift setting. It should further be appreciated that if only the lift of the secondary valve opening is varied, a single actuator 52 is required to control the pivot position of the second intermediate finger follower 50. It should also be appreciated that if lift and phasing are varied, such that they are coupled, only one actuator is required. It should be appreciated that, if lift and phasing are varied, independent of each other, both actuators 52 and 56 are required to control the position of the pivot of the second intermediate finger follower 50.

Figure 3:
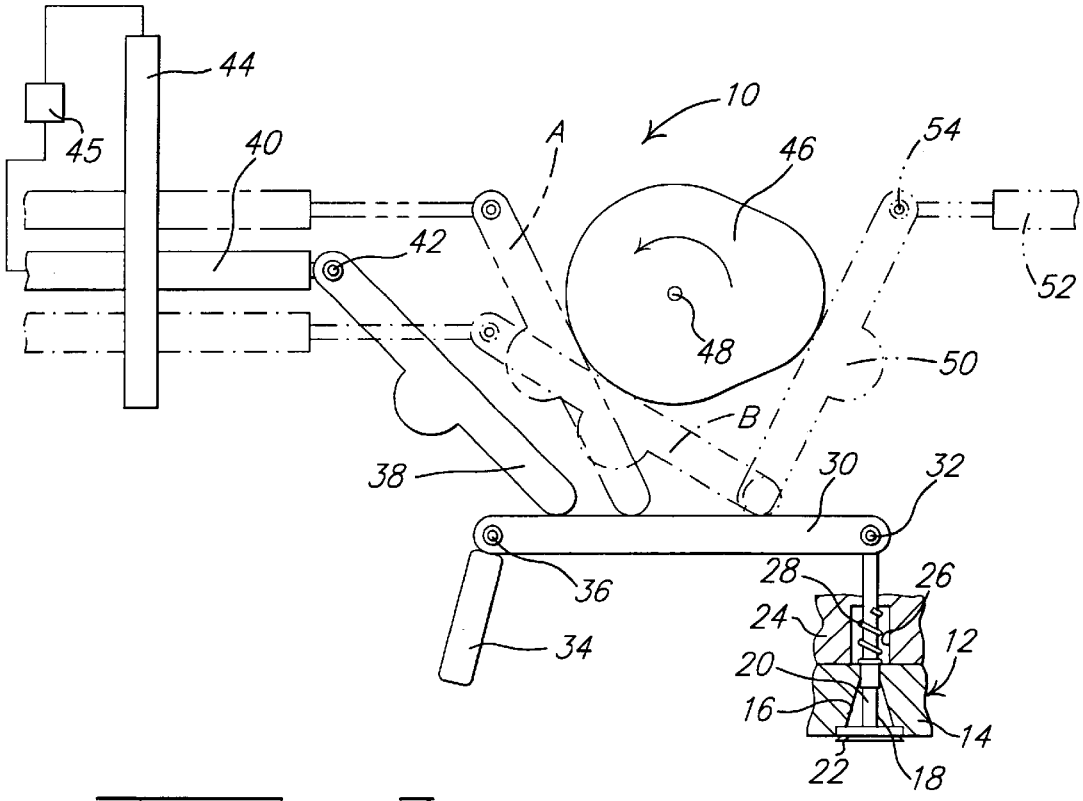
FIG. 3 is a view similar to FIG. 1 of the valve actuator assembly in various positions corresponding to different valve lift and phasing.

As illustrated in FIG. 3, the phantom lines show different positions of the first intermediate finger follower 38 corresponding to different levels of lift and phasing of the engine valve 18. The first intermediate finger follower 38 is illustrated in solid lines with nominal phasing. As the first intermediate finger follower 38 is moved away from the cam center 48 or axis of rotation by the first actuator 40, the level of lift of the engine valve 18 decreases. The first intermediate finger follower 38 is illustrated in solid lines with zero lift. Furthermore, the inclination of the first intermediate finger follower 38 is correlated with valve phasing. A steep inclination of the first intermediate finger follower 38 with respect to the horizontal indicates phase advance as illustrated by the phantom lines and designated as "A" in FIG. 3 and a shallow inclination of the intermediate finger follower 38 with respect to the horizontal indicates a phase retard as illustrated by the phantom lines and designated as "B" in FIG. 3. It should be appreciated that the same operation may be applied to the second intermediate finger follower 50.

Referring to FIG. 4, computation of the pivot location or pivot point 42 for the first intermediate finger follower 38 for the desired lift ($lift_{REF}$) and phasing (θ) is illustrated. The length of the first intermediate finger follower 38 is $l_{IFF}$. For each desired value of lift and phase, the unique position of the first intermediate finger follower 38 is computed in four steps. In step 1, compute the nominal contact point for desired phasing and zero lift as follows:

Nominal Contact Point $$x_{NC_\theta} = -R_1\sin\theta + \frac{(h - R_1\cos\theta)}{\tan\theta}$$

$$y_{NC_\theta} = -h$$

In step 2, compute nominal pivot point corresponding to this contact point as follows:

Nominal Pivot Point $$x_{NP_\theta} = x_{NC_\theta} - l_{IFF}\cos\theta$$

$$y_{NP_\theta} = -h + l_{IFF}\sin\theta$$

In step 3, compute δx using the following equations:

$$lift_{RFF} = lift_{IFF}\cos\theta x\, ratio_{RFF}$$

$$ratio_{RFF} = \frac{l_{IFF}}{x_{NC_\theta} + \delta x - x_{RFF}}$$

$$lift_{IFF} = \delta x\sin\theta x\, ratio_{IFF}$$

$$ratio_{IFF} = \frac{l_{IFF}}{lIFF - \frac{(h - (R_1 - \delta x\sin\theta)\cos\theta}{\sin\theta}}$$

In step 4, compute pivot location of the first intermediate finger follower 38 as follows:

$$(x_{NP}, y_{NP}) = (x_{NP_\theta}, y_{NP_\theta}) + (\delta x, 0)$$

Referring to FIG. 5, computation of the pivot location or pivot point 52 for the second intermediate finger follower 50 for the desired lift ($lift_{REF}$) and phasing (θ) is illustrated. The length of the second intermediate finger follower 50 is $l_{IFF}$. For each desired value of lift and phase, the unique position of the second intermediate finger follower 50 is computed in four steps. In step 1, compute the nominal contact point for desired phasing and zero lift as follows:

Nominal Contact Point $$x_{NC_\theta} = -R_1\sin\theta + \frac{(h - R_1\cos\theta)}{\tan\theta}$$

$$y_{NC_\theta} = -h$$

In step 2, compute nominal pivot point corresponding to this contact point as follows:

Nominal Pivot Point $$x_{NP_\theta} = x_{NC_\theta} - l_{IFF}\cos\theta$$

$$y_{NP_\theta} = -h + l_{IFF}\sin\theta$$

$$y_{NP_\theta} = -h + l_{IFF}\sin\theta$$

In step 3, compute δx using the following equations:

$$lift_{RFF} = lift_{IFF}\cos\theta x\, ratio_{RFF}$$

$$ratio_{RFF} = \frac{l_{IFF}}{x_{NC_\theta} + \delta x - x_{RFF}}$$

$$lift_{IFF} = \delta x\sin\theta x\, ratio_{IFF}$$

$$ratio_{IFF} = \frac{l_{IFF}}{lIFF - \frac{(h - (R_1 - \delta x\sin\theta)\cos\theta}{\sin\theta}}$$

In step 4, compute pivot location of the second intermediate finger follower 50 as follows:

$$(x_{NP}, y_{NP}) = (x_{NP_\theta}, y_{NP_\theta}) + (\delta x, 0)$$

The valve actuator assembly 10 of the present invention has increased functionality, i.e. independent control of valve lift and phase for each individual valve; this means that at any given time, each valve of the engine could be at a different level of lift and phase. The valve actuator assembly 10 of the present invention improves precision and repeatability. The valve actuator assembly 10 of the present invention has a first intermediate finger follower 38 that allows variable lift and phasing of the primary opening of the engine valve 18. The valve actuator assembly 10 of the present invention has a second intermediate finger follower 50 that allows variable lift and phasing of the secondary opening of the engine valve 18.

The present invention has been described in an illustrative manner. It is to be understood that the terminology, which has been used, is intended to be in the nature of words of description rather than of limitation.

Many modifications and variations of the present invention are possible in light of the above teachings. Therefore, within the scope of the appended claims, the present invention may be practiced other than as specifically described.

What is claimed is:

1. A valve actuator assembly for an engine of a vehicle comprising:

a movable engine valve;

a movable roller finger follower contacting said engine valve;

a rotatable cam;

a first intermediate finger follower for contact with said roller finger follower and said cam;

a second intermediate finger follower for contact with said roller finger follower and said cam; and at least one first actuator operatively cooperating with said first intermediate finger follower to position said first intermediate finger follower relative to said cam to move said roller finger follower to position said engine valve at either one of a desired lift and phasing for a primary opening of said engine valve and at least one second actuator operatively cooperating with said second intermediate finger follower to position said second intermediate finger follower relative to said cam to move said roller finger follower to position said engine valve at either one of a desired lift and phasing for a secondary opening of said engine valve.

2. A valve actuator assembly as set forth in claim 1 wherein said roller finger follower has one end in contact with one end of said engine valve.

3. A valve actuator assembly as set forth in claim 2 including a hydraulic lash adjuster pivotally connected to the other end of said roller finger follower.

4. A valve actuator assembly as set forth in claim 1 wherein said at least one first actuator is pivotally connected to one end of said first intermediate finger follower.

5. A valve actuator assembly as set forth in claim 1 wherein said at least one second actuator is pivotally connected to one end of said second intermediate finger follower.

6. A valve actuator assembly as set forth in claim 1 wherein said at least one first actuator moves said first intermediate finger follower in at least one of a horizontal direction and a vertical direction.

7. A valve actuator assembly as set forth in claim 1 wherein said at least one second actuator moves said second intermediate finger follower in at least one of a horizontal direction and a vertical direction.

8. A valve actuator assembly as set forth in claim 1 wherein said at least one first actuator comprises a first actuator pivotally connected to said first intermediate finger follower to move said first intermediate finger follower in a horizontal direction and a third actuator operatively cooperating with said first actuator to move said first actuator and said first intermediate finger follower in a vertical direction.

9. A valve actuator assembly as set forth in claim 1 wherein said at least one second actuator comprises a second actuator pivotally connected to said second intermediate finger follower to move said second intermediate finger follower in a horizontal direction and a fourth actuator operatively cooperating with said second actuator to move said second actuator and said second intermediate finger follower in a vertical direction.

10. A valve actuator assembly as set forth in claim 1 including a controller electrically connected to said at least one first actuator and said at least one second actuator to energize and de-energize said at least one first actuator and said at least one second actuator.

11. A valve actuator assembly as set forth in claim 1 including a housing having a chamber and an engine valve spring disposed in said chamber to bias said engine valve toward a closed position.

12. A valve actuator assembly comprising:

a movable engine valve;

a movable roller finger follower connected to said engine valve;

a rotatable cam;

a first intermediate finger follower contacting said roller finger follower;

a second intermediate finger follower contacting said roller finger follower; and a first actuator connected to said first intermediate finger follower to move said first intermediate finger follower in either one of a horizontal direction and a vertical direction to position said first intermediate finger follower relative to said cam to move said roller finger follower to position said engine valve for a primary opening of said engine valve at either one of a desired lift and phasing and a second actuator connected to said second intermediate finger follower to move said second intermediate finger follower in either one of a horizontal direction and a vertical direction to position said second intermediate finger follower relative to said cam to move said roller finger follower to position said engine valve for a secondary opening of said engine valve at either one of a desired lift and phasing.

13. A valve actuator assembly as set forth in claim 12 wherein said first actuator is pivotally connected to one end of said first intermediate finger follower.

14. A valve actuator assembly as set forth in claim 12 wherein said second actuator is pivotally connected to one end of said second intermediate finger follower.

15. A valve actuator assembly as set forth in claim 12 wherein said first actuator is pivotally connected to said first intermediate finger follower and including a third actuator operatively cooperating with said first actuator to move said first actuator and said first intermediate finger follower.

16. A valve actuator assembly as set forth in claim 15 wherein said second actuator is pivotally connected to said second intermediate finger follower and including a fourth actuator operatively cooperating with said second actuator to move said second actuator and said second intermediate finger follower.

17. A valve actuator assembly as set forth in claim 12 wherein said roller finger follower has one end in contact with one end of said engine valve.

18. A valve actuator assembly as set forth in claim 12 including a hydraulic lash adjuster pivotally connected to the other end of said roller finger follower.

19. A valve actuator assembly as set forth in claim 12 including a controller electrically connected to said first actuator and said second actuator to energize and de-energize said first actuator and said second actuator.

20. A method of operating a valve actuator assembly for a vehicle comprising:

providing a movable engine valve;

providing a movable roller finger follower connected to the engine valve;

providing a cam and rotating the cam;

providing a first intermediate finger follower and contacting the roller finger follower;

providing a second intermediate finger follower and contacting the roller finger follower;

actuating at least one first actuator operatively cooperating with the first intermediate finger follower, positioning the first intermediate finger follower relative to the cam, and positioning the engine valve at either one of a desired lift and phasing for a primary opening of the engine valve; and actuating at least one second actuator operatively cooperating with the second intermediate finger follower, positioning the second intermediate finger follower relative to the cam, and positioning the engine valve at either one of a desired lift and phasing for a secondary opening of the engine valve.

* * * * *